US007163239B2

(12) United States Patent
Fisher

(10) Patent No.: US 7,163,239 B2
(45) Date of Patent: Jan. 16, 2007

(54) ACTUATOR ASSEMBLY

(75) Inventor: Sidney Edward Fisher, Redditch (GB)

(73) Assignee: ArvinMeritor Light Vehicle Systems (UK) Ltd., Birmingham (GB)

( * ) Notice: Subject to any disclaimer, the term of this patent is extended or adjusted under 35 U.S.C. 154(b) by 0 days.

(21) Appl. No.: 11/071,999

(22) Filed: Mar. 4, 2005

(65) Prior Publication Data

US 2005/0205361 A1 Sep. 22, 2005

(30) Foreign Application Priority Data

Mar. 6, 2004 (GB) ..... 0405153.8

(51) Int. Cl.
*E05C 3/06* (2006.01)
*E05C 3/16* (2006.01)

(52) U.S. Cl. ..... 292/216; 292/201; 185/37; 74/425; 74/388 R

(58) Field of Classification Search ..... 292/216, 292/201 X; 49/280; 74/425 X, 89.14, 421 A, 74/63, 388 R, 425, 411, 404; 70/278.7, 280; 310/75 R, 83, 754, 97; 185/11, 40 R, 37, 185/40 B
See application file for complete search history.

(56) References Cited

U.S. PATENT DOCUMENTS 3,599,022 A * 8/1971 Adair ..... 310/65
4,096,842 A * 6/1978 Kurata ..... 123/185.14
4,125,231 A * 11/1978 Henderson ..... 242/375.3
4,340,190 A * 7/1982 Zavatkay ..... 242/375.2
4,662,236 A * 5/1987 Kobayashi ..... 74/501.6
5,603,537 A 2/1997 Amano et al.
6,102,454 A 8/2000 Weyerstall
6,196,894 B1 * 3/2001 Kennedy et al. ..... 446/461
6,208,103 B1 * 3/2001 Kachouh ..... 318/468

(Continued)

FOREIGN PATENT DOCUMENTS

EP 0 267 423 5/1988

(Continued)

OTHER PUBLICATIONS

United Kingdom Search Report dated Aug. 6, 2004.

*Primary Examiner*—Brian E. Glessner
*Assistant Examiner*—Mark Williams
(74) *Attorney, Agent, or Firm*—Carlson, Gaskey & Olds

(57) ABSTRACT

An actuator assembly includes an actuator drivingly connected to a gear wheel. The gear wheel includes an abutment secured rotationally fast having a camming surface and operable to drive an output member. The actuator assembly is operable to apply a force in a first direction to drive the output member in the first direction from a rest condition to an actuated condition and is operable to apply a force in a second direction to drive the output member in the second direction from the actuated condition to the rest condition. Movement of the output member in the second direction stores energy in the energy storage device, and movement of the output member in the first direction is assisted by the energy storage device. When the actuator assembly is in the rest condition, a detent engages the energy storage device to releasably retain the energy storage device in a rest position. Actuation of the actuator causes the camming surface to disengage the detent from the energy storage device to allow the energy storage device to assist movement of the output member in the first direction.

10 Claims, 6 Drawing Sheets

U.S. PATENT DOCUMENTS 6,441,516 B1 * 8/2002 Kaelin et al. ..... 310/36
6,522,095 B1 * 2/2003 Kachouh ..... 318/445
6,679,217 B1 * 1/2004 Nieda et al. ..... 123/185.14
6,694,941 B1 * 2/2004 Ueda et al. ..... 123/185.14
6,758,181 B1 * 7/2004 Iida et al. ..... 123/179.24
2004/0112008 A1 * 6/2004 Voss et al. ..... 53/329.3

FOREIGN PATENT DOCUMENTS

EP 1 387 027 2/2004

* cited by examiner

ACTUATOR ASSEMBLY

REFERENCE TO RELATED APPLICATION

This application claims priority to United Kingdom Patent Application No. GB 0405153.8 filed on Mar. 6, 2004.

BACKGROUND OF THE INVENTION

The present invention relates generally to an actuator assembly, in particular to an actuator assembly used with a latch assembly of a vehicle door, such as a car door.

European Patent Application EP01300813 describes an actuator assembly including a spring used to assist an actuator motor when the actuator assembly is actuated. Once actuated, the actuator motor is then powered in a reverse direction to restore the actuator assembly to a rest condition, and in particular to store energy in the spring in preparation for the next actuation operation.

In particular, FIG. 3 of European Patent Application EP01300813 shows a worm wheel that is driven by a motor and operates to drive a separate output lever. The output lever acts to store energy in the spring, and a stop pawl acts on an abutment of the output lever to ensure that the output lever remains in the rest condition. The stop pawl is disengaged by a ramp surface of the worm wheel. In particular, the ramp surface is rotatable relative to the abutment of the output lever.

However, this arrangement is complicated because it includes an output lever which is separate from the worm wheel. Furthermore, the output lever is complicated to produce and has various abutments, slots and output pins. Furthermore, this arrangement is not particular compact because a space envelope is required for both the worm wheel and the output lever and a further space envelope is required for the spring and an associated housing.

SUMMARY OF THE INVENTION

An object of the present invention is to provide an actuator assembly that is less expensive and/or easier to produce. Another object of the present invention is to provide an actuator assembly that has fewer components. Another object of the present invention is to provide an actuator assembly that is more compact.

Thus, the present invention provides an actuator assembly including an actuator drivingly connected to a gear wheel. The gear wheel includes an abutment secured rotationally fast having a camming surface and operable to drive an output member. The actuator assembly is operable to apply a force in a first direction to drive the output member in the first direction from a rest condition to an actuated condition and is operable to apply a force in a second direction to drive the output member in the second direction from the actuated condition to the rest condition.

The actuator assembly further includes an energy storage device, and movement of the output member in the second direction by the actuator provides stored energy in the energy storage device. Movement of the output member in the first direction is assisted by the energy storage device by the release of the stored energy. The energy storage device acts on the abutment to assist movement of the output member in the first direction.

When the actuator assembly is in the rest condition, a detent engages the energy storage device to releasably retain the energy storage device in a rest position. An actuation of the actuator assembly causes the camming surface of the abutment to disengage the detent from the energy storage device to allow the energy storage device to assist movement of the output member in the first direction.

Other characteristics and advantages of the invention will become apparent when reading the following detailed description of the embodiments of the invention, given as an example only and with reference to the drawings.

BRIEF DESCRIPTION OF THE DRAWINGS

The invention will now be described, by way of example only, with reference to the accompanying drawings in which.

DETAILED DESCRIPTION OF THE PREFERRED EMBODIMENT

Figure 1:
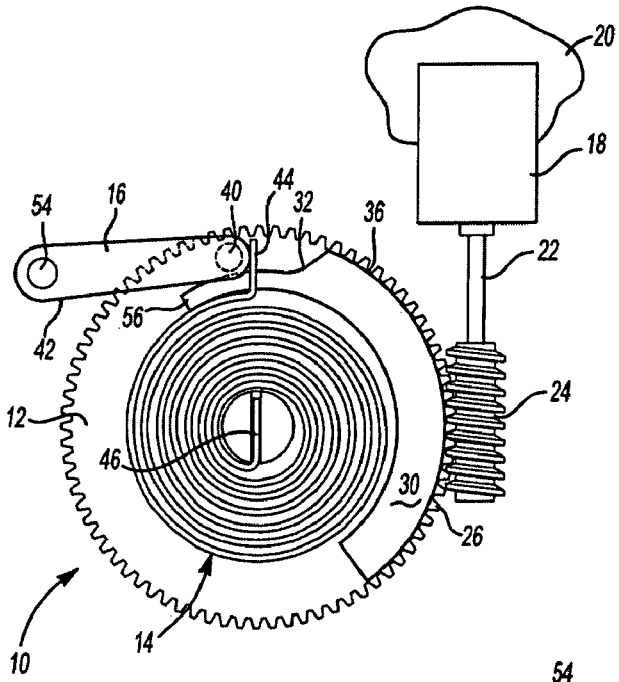
FIG. 1 shows an actuator assembly of the present invention in a rest condition.
Figure 10:
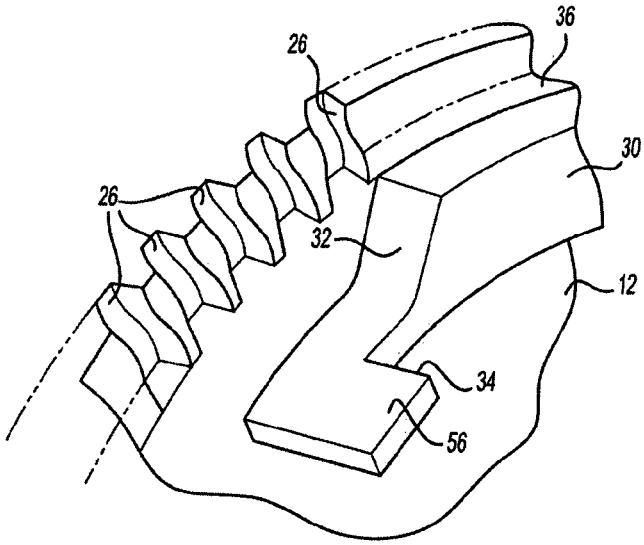
FIG. 10 shows a perspective view of a portion of the worm wheel of the actuator assembly.

FIG. 1 shows an actuator assembly 10 including a gear wheel in the form of a worm wheel 12, an energy storage member in the form of a spiral spring 14, a detent in the form of a pawl 16, a power actuator in the form of a motor 18 (shown schematically) and an actuator assembly body 20 (only part of which is shown). The motor 18 is mounted on the actuator assembly body 20 and includes a motor shaft 22 drivingly coupled to a pinion 24. The pinion 24 drivingly engages teeth 26 (see FIG. 10) of the worm wheel 12.

The worm wheel 12 (best seen in FIGS. 7A and 10) includes a pivot 28 and a boss 30 having a camming surface 32 that are both near the worm wheel 12 and an abutment 34 and a region 56 that are both remote from the worm wheel 12. The boss 30 further includes a peripheral surface 36 which extends through an arc of approximately 120 degrees. The worm wheel 12 is pivotally mounted via the pivot 28 on the actuator assembly body 20 about an axis A which is substantially coaxial with an axis of the spiral spring 14.

Figure 9:
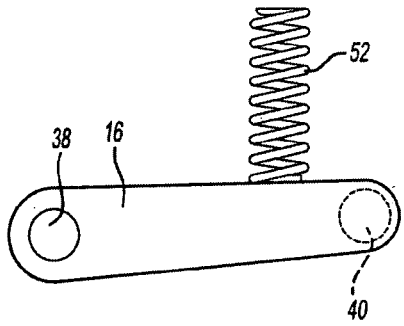
FIG. 9 shows a pawl of the actuator assembly.
Figure 11:
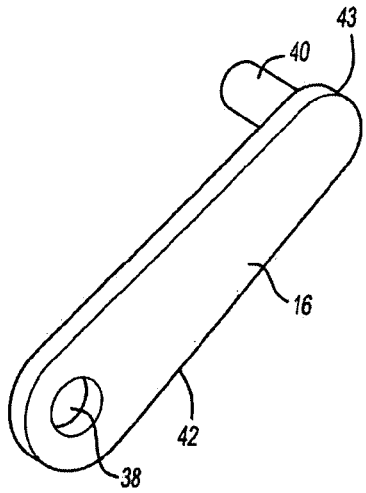
FIG. 11 shows a perspective view of the pawl of the actuator assembly.

As shown in FIG. 11, the pawl 16 is generally elongate and includes a pivot hole 38 at one end and a camming pin 40 at the other end 43. An edge 42 of the pawl 16 engages the spiral spring 14, as will be further described below. The pawl 16 is pivotally mounted on a boss 54, which in turn is secured to the actuator assembly body 20. A spring 52 (shown schematically in FIG. 9) biases the pawl 16 in a clockwise direction about the boss 54.

Figure 7:
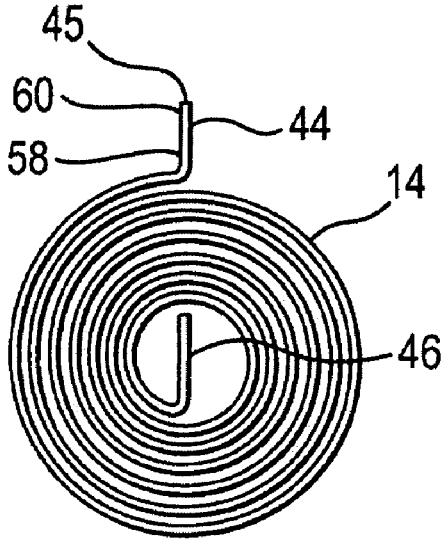
FIG. 7 shows a spiral spring of the actuator assembly.
Figure 8:
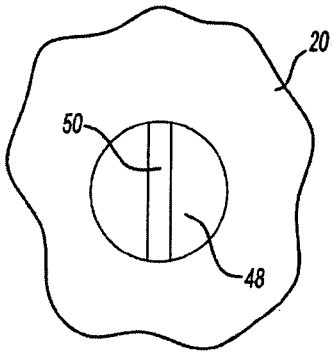
FIG. 8 shows a portion of an actuator assembly body of the actuator assembly.

As shown in FIG. 7, the spiral spring 14 includes several (in this case six) turns and has a radially outer end 44 and a radially inner end 46. Both the radially outer end 44 and the radially inner end 46 are radially orientated relative to an axis of the spiral spring 14. As shown in FIG. 8, a generally circular spring mount boss 48 is provided on the actuator assembly body 20. The spring mount boss 48 includes a radially orientated slit 50. The radially inner end 46 of the spiral spring 14 is positioned within the slit 50 of the spring mount boss 48 to secure the radially inner end 46 of the spiral spring 14 rotationally fast with the actuator assembly body 20. The radially outer end 44 includes a tip 45, a radially outer region 60 and a radially inner region 58.

When assembled, the camming pin 40 of the pawl 16 lies in the path of the camming surface 32 and the peripheral surface 36 of the boss 30.

The edge 42 of the pawl 16 lies in the path of the tip 45 of the radially outer end 44 of the spiral spring 14. FIG. 1 shows the components of the actuator assembly 10 in an assembled condition and a rest condition. The spring 52 has biased the edge 42 of the pawl 16 into engagement with the region 56 of the boss 30. The abutment 34 is in engagement with the radially inner region 58 of the radially outer end 44 of the spiral spring 14. The end 43 of the pawl 16 is in engagement with the radially outer region 60 of the radially outer end 44 of the spiral spring 14.

The spiral spring 14 is under a load such that the spiral spring 14 is biased to unwind, and hence a spring force is applied to the end 43 of the pawl 16. However, because of the geometrical arrangement as shown in FIG. 1, the pawl 16 remains in this position, and the spiral spring 14 cannot unwind. Under these circumstances, energy is stored in the spiral spring 14.

Figure 2:
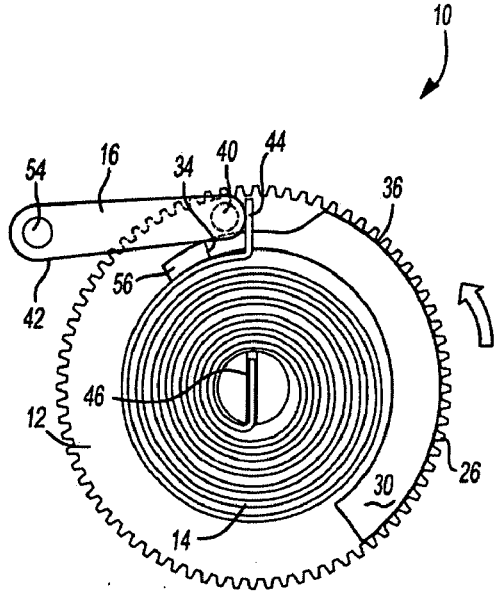
FIG. 2 shows the actuator assembly in an intermediate condition as it moves to an actuated condition.
Figure 3:
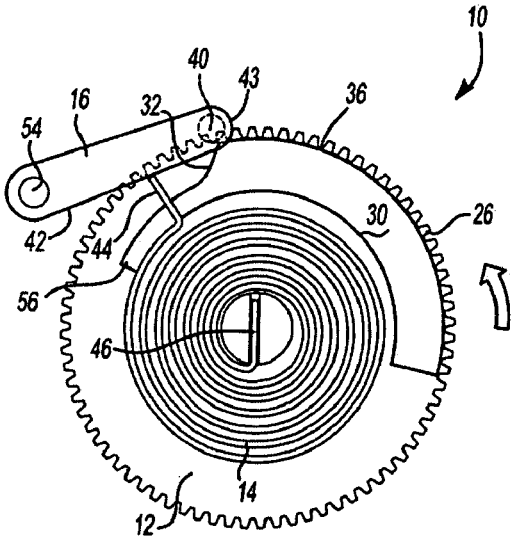
FIG. 3 shows the actuator assembly in another intermediate condition as it continues to move to the actuated condition.
Figure 4:
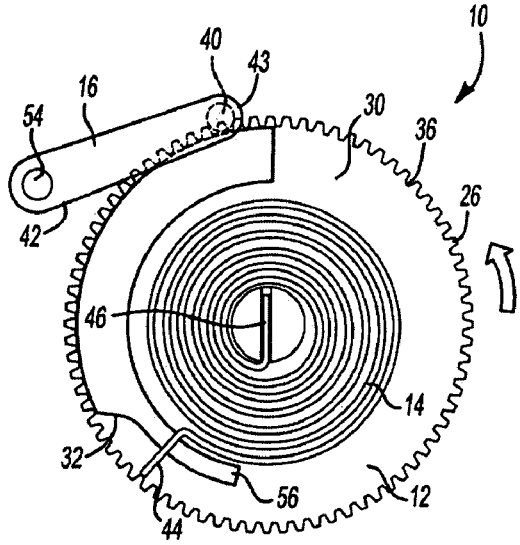
FIG. 4 shows the actuator assembly in the actuated condition.

Operation of the actuator is as follows. Starting from the position shown in FIG. 1, the motor 18 is powered such that the worm wheel 12 rotates about the axis A in a counter-clockwise direction. This causes the abutment 34 to become disengaged from the radially inner region 58 of the spiral spring 14 and simultaneously causes the camming surface 32 to approach the camming pin 40 of the pawl 16. This position is shown in FIG. 2, and the pawl 16 and the spiral spring 14 are in the same position as shown in FIG. 1. Continued rotation of the worm wheel 12 causes the camming surface 32 to engage the camming pin 40 of the pawl 16 and thereby rotate the pawl 16 in a counter-clockwise direction about the boss 54. In doing so, the end 43 of the pawl 16 moves generally radially outwardly relative to the axis A until the pawl 16 can no longer restrain the spiral spring 14. Then, the tip 45 of the spiral spring 14 can rotate underneath the edge 42 of the pawl 16, and the radially inner region 58 of the spiral spring 14 can re-engage the abutment 34, as shown in FIG. 3. The camming pin 40 of the pawl 16 now rests on the peripheral surface 36, and this engagement ensures that as the worm wheel 12 continues to rotate in a counter-clockwise direction to the position shown in FIG. 4, the pawl 16 remains in the position shown in FIGS. 3 and 4. During movement of the worm wheel 12 from the FIG. 3 position to the FIG. 4 position, the spiral spring 14 assists the motor 18 since the spiral spring 14 is still under the load in the position shown in FIG. 4.

Figure 5:
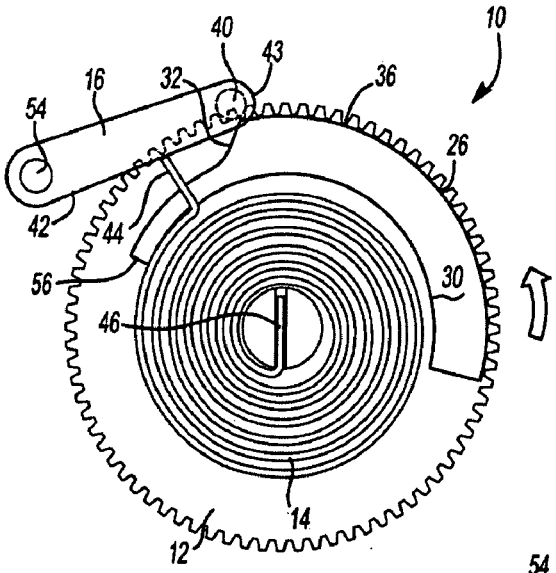
FIG. 5 shows the actuator assembly as it begins to return to the rest condition.
Figure 6:
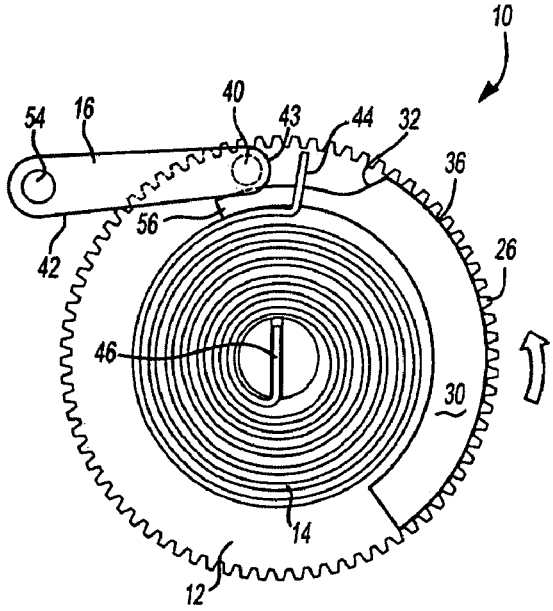
FIG. 6 shows the actuator assembly when it has returned to the rest condition.

To return the actuator assembly to the rest position, the motor 18 is powered in the opposite direction to rotate the worm wheel 12 in a clockwise direction through the position shown in FIG. 5 to the position shown in FIG. 6. As this occurs, and as mentioned above, the peripheral surface 36 ensures that the pawl 16 is not biased clockwise by the spring 52. FIG. 5 shows the position at which the camming pin 40 of the pawl 16 is about to disengage peripheral surface 36. At this moment, the tip 45 of the spiral spring 14 has just engaged the edge 42 of the pawl 16. Thus, continued clockwise rotation of the worm wheel 12 from the position shown in FIG. 5 causes the tip 45 of the spiral spring 14 to move along the edge 42 of the pawl 16 and a spring force is created by the spring 52. Once the tip 45 has moved past the end 43 of the pawl 16 (as shown in FIG. 6), then the spring 52 biases the pawl 16 clockwise such that part of the edge 42 of the pawl 16 engages the region 56 as shown in FIG. 6. Once power to the motor 18 is stopped, the spiral spring 14 returns the components to the rest position, as shown in FIG. 1.

Figure 7A:
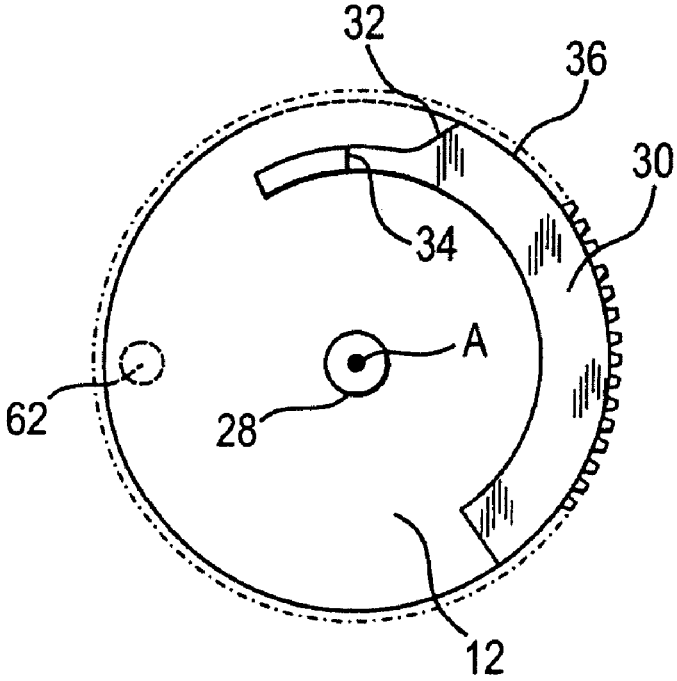
FIG. 7A shows a worm wheel of the actuator assembly.

In use, the worm wheel 12 is connected to an output member 62, and the output member 62 can be connected to components that require actuation. The output member 62 can be of a particularly simple nature. An example of an output member 62 is a circular boss mounted on a side of the worm wheel 12 opposite to the boss 30, as shown in FIG. 7A. Alternatively, the output member 62 can be a simple lever connected to the worm wheel 12. Those skilled in the art will appreciate that other forms of the output member 62 could be used, including an output shaft or an output gear either mounted directly to worm wheel 12 or mounted on a shaft connected to the worm wheel 12.

The actuator assembly 10 is particularly applicable for use with a latch assembly of a vehicle, such as a car. Latch assemblies for passenger doors, boots, bonnets and other closures of cars are known where a latch bolt, typically in the form of a rotating claw, is releasably securable in a closed position by a latch pawl. The claw includes a mouth for releasably receiving a striker, typically mounted on a fixed structure of the vehicle. The pawl includes a pawl tooth which engages the claw, thereby latching the latch. Disengagement of the pawl tooth from the claw allows the claw to rotate to release the striker and thereby allow the door to open.

Figure 12:
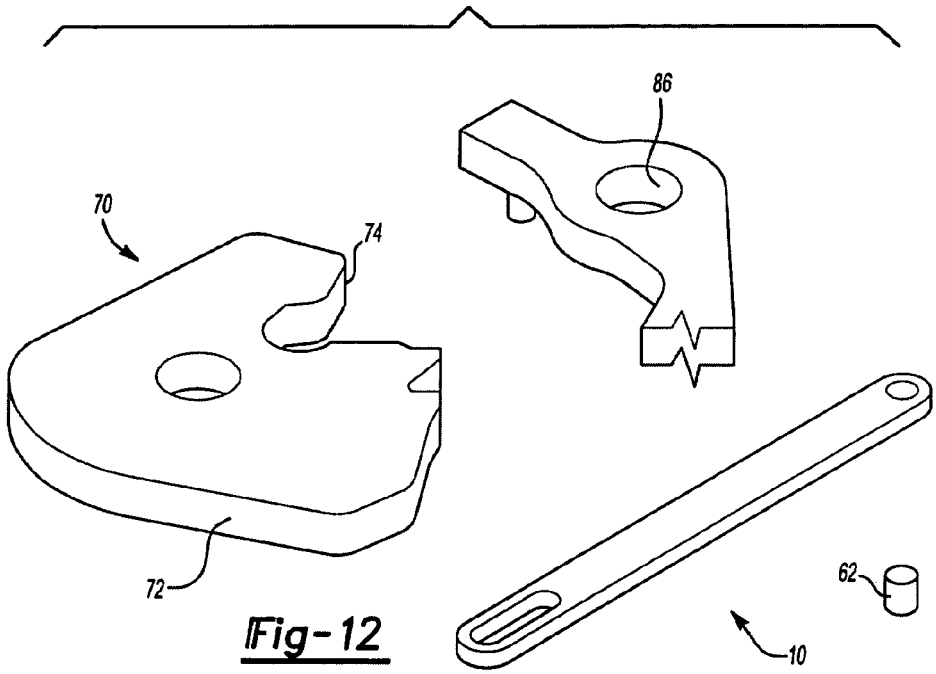
FIG. 12 show a top view of a latch assembly with which the actuator assembly can be used.
Figure 13:
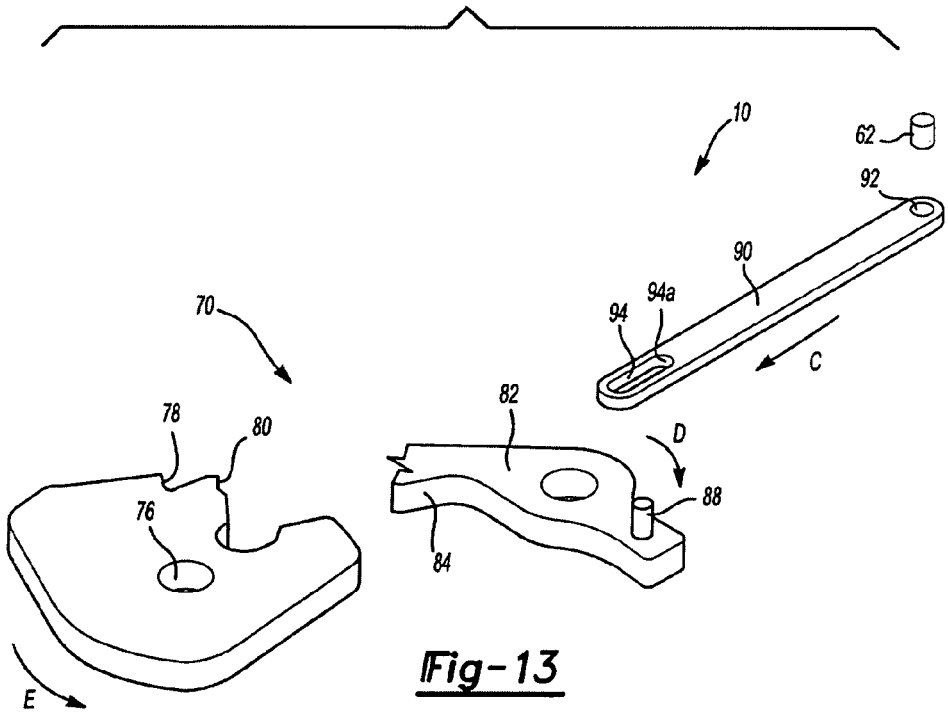
FIG. 13 shows a bottom view of a latch assembly with which the actuator assembly can be used.

FIGS. 12 and 13 show an isometric exploded top view and a bottom view, respectively, of a latch assembly 70 (only part of which is shown) which includes the actuator assembly 10 (only part of which is shown) according to the present invention. The latch assembly 70 includes a latch bolt in the form of a rotating latch claw 72 having a mouth 74 for releasably receiving a striker (not shown). The latch claw 72 is rotatably mounted via a hole 76 on a pivot pin (not shown).

The latch claw 72 includes a first safety abutment 78 and a fully closed abutment 80 which are engageable by a pawl tooth 84 of a latch pawl 82. The latch pawl 82 is pivotally mounted via a hole 86 on a pivot pin and includes a pawl release pin 88. A link 90 connects the output member 62, such as a boss, of the actuator assembly 10 (only the output member 62 is shown for clarity) to the latch pawl 82. In particular, the output member 62 engages a hole 92 of the link 90, and the pawl release pin 88 engages a slotted hole 94 of the link 90. The slotted hole 94 provides a lost motion connection between the link 90 and the latch pawl 82, i.e., it allows the link 90 to move linearly in a direction of arrow C to a limited extent without starting to move the latch pawl 82. Those skilled in the art will readily appreciate that with the latch assembly 70 in a latched condition, operation of the actuator assembly 10 will cause the output member 62 to rotate and thus causes the link 90 to move generally linearly in the direction of arrow C. An end 94A of the slotted hole 94 engages and then displaces the pawl release pin 88. This causes the latch pawl 82 to rotate in the direction of arrow D, thereby releasing the pawl tooth 84 from the fully closed abutment 80 and allowing the rotating latch claw 72 to rotate in the direction of arrow E to release the striker and allow the associated closure to be opened.

There will clearly be a frictional force between the pawl tooth 84 and the fully closed abutment 80 as the latch starts to open, i.e., as the latch pawl 82 starts to rotate. The actuator force required to overcome this friction is significantly greater than the actuator force required to move the link 90 alone (i.e., when the link 90 is being moved but the end 94A of the slotted hole 94 has not yet engaged the pawl release pin 88). Because of this, it is beneficial that the actuator assembly 10 reaches the position shown in FIG. 3 just as, or preferably just prior to, the end 94A of the slotted hole 94 engaging the pawl release pin 88. Under these circumstances, full spring assist is available as the latch begins to open, i.e., as the latch pawl 82 starts to rotate, and hence as the pawl tooth 84 begins to slide across the fully closed abutment 80.

Those skilled in the art will readily appreciate that there are many alternatives to providing a lost motion connection between the output member 62 of the actuator assembly 10 according to the present invention and the latch pawl 82 of the latch assembly 70 used with the actuator assembly 10 according to the present invention.

When the actuator assembly 10 is used with the latch assembly 70, the motor 18 will be powered to release the latch. When the latch assembly 70 is used in a passenger door, the motor 18 might typically be powered for a set time such as half a second (or less). This time period is set to ensure that under all foreseeable conditions, the latch pawl 82 is disengaged from the latch claw 72. Typically, under normal operating conditions, it might take 0.1 or 0.2 seconds for the latch pawl 82 to disengage from the latch claw 72. Under these circumstances, the motor 18 is stalled for the remainder of the timed period. Alternatively, the motor 18 may be powered continuously until sensors within the latch assembly 10 detect that the latch pawl 82 has disengaged from the latch claw 72. Typically, microswitches might be used to detect the position of the latch pawl 82 or the latch claw 72.

Once the latch has been opened, the motor 18 can then be powered to re-wind the spiral spring 14. Typically, this might occur as soon as a sensor detects that the latch claw 72 has been opened. Alternatively, a control system can provide a short time delay (such as 20 second or less or 10 seconds or less) following which the motor 18 is powered to rewind the spiral spring 14.

An example sequence might be first powering the motor 18 for half a second to open the latch, then detecting an open position of the latch claw 72 via a sensor (such as a microswitch or the like), and then powering the motor 18 in a reverse direction for half a second to rewind the spiral spring 14.

Alternatively, the motor 18 could be powered to rewind the spiral spring 14 only upon closing of the door. Typically, sensors would detect an open position and a closed position of the latch claw 72. When the door is opened, the open position of the latch claw 72 will be detected. The control system would then recognize that the spiral spring 14 needs rewinding. Once the door is closed, the sensor that detects the closed position of the latch claw 72 would send a signal to the control system, prompting the motor 18 to rewind the spiral spring 14.

Figure 14:
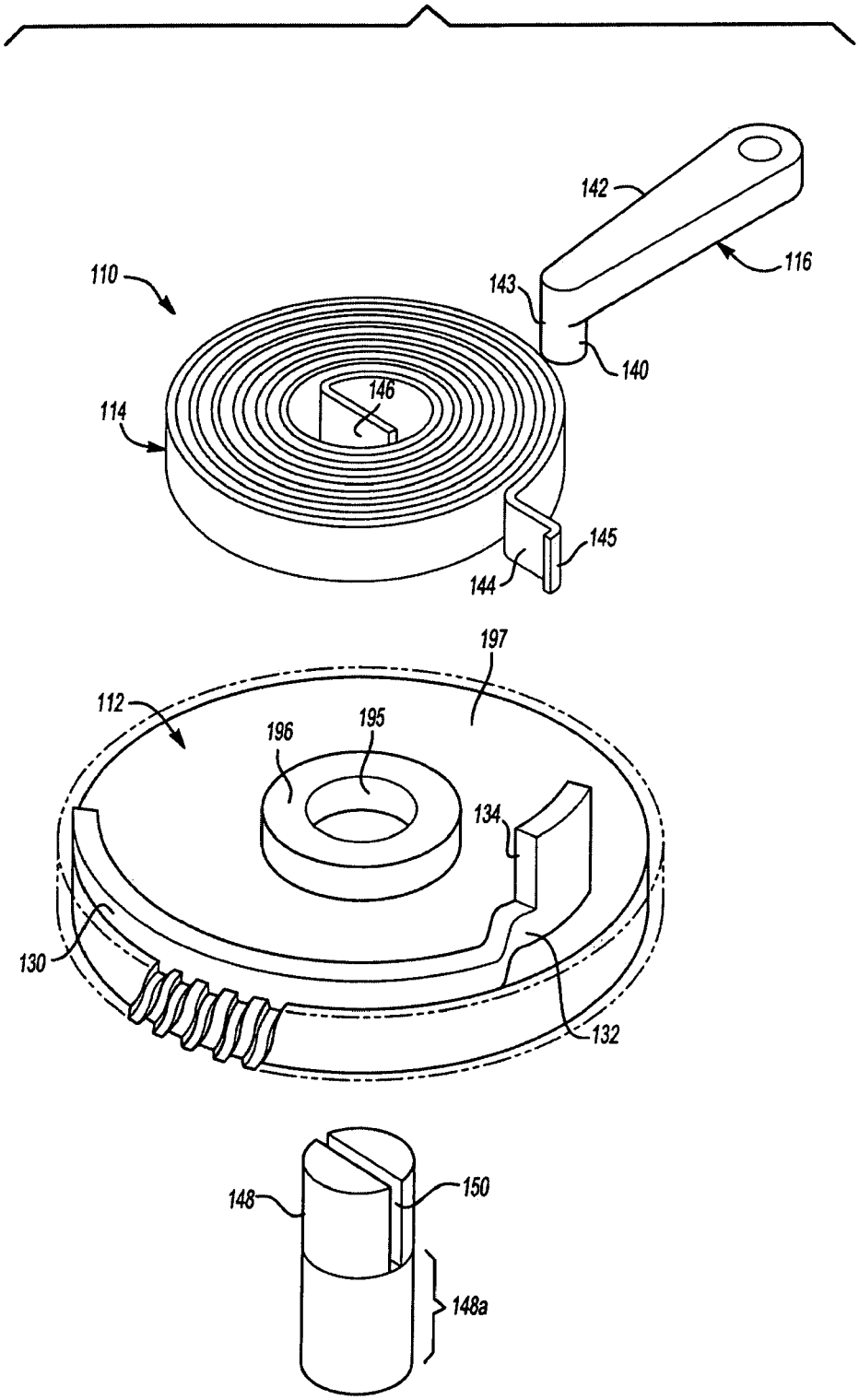
FIG. 14 shows an exploded view of certain components of a second embodiment of an actuator assembly according to the present invention.

FIG. 14 shows an actuator assembly 110 in which components that fulfill the same function as those of the actuator assembly 10 are labelled 100 greater. The actuator assembly 110 is provided by taking the components shown in FIG. 14 and substituting them for the equivalent components shown in FIG. 1 to provide the actuator assembly 110.

A worm wheel 112 includes an output member boss (not shown, but similar to the output member 62) or an equivalent feature to enable the actuator assembly 110 to be used with a latch assembly in a manner similar to the actuator assembly 10.

A tip 145 of a spiral spring 114 is bent to provide a smooth, non-sharp, surface against which an edge 142 of a pawl 116 acts in use. A camming pin 140 of the pawl 116 has a radius equivalent to an end 143 of the pawl 116.

The worm wheel 112 includes a central hole 195 through which a spring mount boss 148 projects. A lower portion 148A of the spring mount boss 148 acts together with the central hole 195 to allow the worm wheel 112 to pivot relative to an actuator assembly body (not shown).

The worm wheel 112 includes an annular boss 196 which projects above a surface 197 by an amount equivalent to an amount by which a main circumferential region of the boss 130 projects above the surface 197. In this manner, a radially inner end 146 of the spiral spring 114 can be supported such that a radially outer end 144 of the spiral spring 114 is presented in the correct plane relative to an abutment 134 of the boss 130.

The foregoing description is only exemplary of the principles of the invention. Many modifications and variations are possible in light of the above teachings. It is, therefore, to be understood that within the scope of the appended claims, the invention may be practiced otherwise than using the example embodiments which have been specifically described. For that reason the following claims should be studied to determine the true scope and content of this invention.

What is claimed is:

1. An actuator assembly comprising:

an assembly body carrying:

a gear wheel including an abutment rotationally fixed with a camming surface, the gear wheel being operable to drive an output member, a detent to interact with the camming surface, and an actuator drivingly connected to the gear wheel and operable to apply a force in a first direction to drive the output member in the first direction from a rest condition of the actuator assembly to an actuated condition of the actuator assembly and operable to apply a force in a second direction to drive the output member in the second direction from the actuated condition to the rest condition; and an energy storage device including a first end rotationally fixed with the assembly body, wherein movement of the output member in the second direction by the actuator stores energy in the energy storage device and movement of the output member in the first direction by the actuator is assisted by the energy storage device by release of the energy stored in the energy storage device, wherein the energy storage device acts on the abutment to assist movement of the output member in the first direction, and wherein the detent engages the energy storage device to releasably retain the energy storage device in an energy storage device rest position when the actuator assembly is in the rest condition, and an initial actuation of the actuator causes the camming surface to disengage the detent from the energy storage device to allow the energy storage device to assist further actuation of the actuator to move the output member in the first direction.

2. The actuator assembly as defined in claim 1 wherein the actuator assembly is moveable between the rest condition and the actuated condition and has an intermediate condition between the rest condition and the actuated condition, and wherein the detent is disengaged from the camming surface when the actuator assembly is in the rest condition, and the detent engages both the energy storage device and the camming surface and the abutment is disengaged from the energy storage device when the actuator assembly is in the intermediate condition, and the detent is disengaged from the energy storage device and the camming surface and the abutment engages the energy storage device when the actuator assembly is in the actuated condition.

3. The actuator assembly as defined in claim 1 wherein the energy storage device is a spiral spring.

4. The actuator assembly as defined in claim 3 wherein the first end of the energy storage device is a radially inner end.

5. The actuator assembly as defined in claim 4 wherein the energy storage device includes a radially outer end that engages the abutment.

6. The actuator assembly as defined in claim 5 wherein the radially outer end of the energy storage device is engaged by the detent.

7. The actuator assembly as defined in claim 1 wherein the gear wheel includes a common projection, and the abutment and the camming surface are provided on the common projection.

8. The actuator assembly as defined in claim 7 wherein the camming surface is proximate a surface of the gear wheel and the abutment is remote from the surface of the gear wheel.

9. A latch assembly comprising:

a latch bolt releasably securable in a closed position by a latch pawl; and an actuator assembly including:

an assembly body carrying:

a gear wheel including an abutment rotationally fixed with a camming surface, the gear wheel being operable to drive an output member, a detent to interact with the camming surface, and an actuator drivingly connected to the gear wheel and operable to apply a force in a first direction to drive the output member in the first direction from a rest condition of the actuator assembly to an actuated condition of the actuator assembly and operable to apply a force in a second direction to drive the output member in the second direction from the actuated condition to the rest conditions, an energy storage device including a first end rotationally fixed with the assembly body, wherein movement of the output member in the second direction by the actuator stores energy in the energy storage device and movement of the output member in the first direction by the actuator is assisted by the energy storage device by release of the energy stored in the energy storage device, wherein the energy storage device acts on the abutment to assist movement of the output member in the first direction, wherein the detent engages the energy storage device to releasably retain the energy storage device in an energy storage device rest position when the actuator assembly is in the rest condition, and an initial actuation of the actuator causes the camming surface to disengage the detent from the energy storage device to allow the energy storage device to assist further actuation of the actuator to move the output member in the first direction, and wherein the output member is connected to the latch pawl, and operation of the actuator causes the latch pawl to release the latch bolt.

10. The latch assembly as defined in claim 9 wherein a lost motion connection between the gear wheel and the latch pawl enables the camming surface to disengage the detent from the energy storage device prior to the latch pawl beginning to release the latch bolt.

* * * * *

UNITED STATES PATENT AND TRADEMARK OFFICE

CERTIFICATE OF CORRECTION

PATENT NO. : 7,163,239 B2
APPLICATION NO. : 11/071999
DATED : January 16, 2007
INVENTOR(S) : Sidney Edward Fisher It is certified that error appears in the above-identified patent and that said Letters Patent is hereby corrected as shown below:

Column 8, line 14: “conditions” should be --condition--

Signed and Sealed this

Twentieth Day of March, 2007

JON W. DUDAS
*Director of the United States Patent and Trademark Office*